US005115825A

United States Patent [19]

Kuhn

[11] Patent Number: 5,115,825

[45] Date of Patent: May 26, 1992

[54] HAIR BAND HAVING TEMPERATURE SENSITIVE LIQUID CRYSTAL

[76] Inventor: Jessica E. Kuhn, 558 San Diego Ave., Hollywood, Pa. 19111

[21] Appl. No.: 702,012

[22] Filed: May 17, 1991

[51] Int. Cl.[5] ..... A45D 8/34

[52] U.S. Cl. ..... 132/273; 132/275; 132/278; 24/575

[58] Field of Search ..... 132/273, 275, 278, 279; 63/3, 11; 24/575, 576, 579.1

[56] References Cited

U.S. PATENT DOCUMENTS

| | | | |
|---|---|---|---|
| 692,584 | 2/1902 | Adams et al. | 24/575 |
| 1,172,726 | 2/1916 | Paine | 63/11 |
| 1,249,959 | 12/1917 | Hodges | 24/579 |
| 2,661,748 | 12/1953 | Raeho | 132/275 |
| 2,771,768 | 11/1956 | Tudor | 63/3 |
| 3,301,266 | 1/1967 | Hoffmann | 132/273 |
| 3,751,769 | 8/1973 | Reiner | 132/273 |
| 4,317,337 | 3/1982 | Walden et al. | 63/3 |
| 4,753,086 | 6/1988 | Schmidt | 63/3 |

FOREIGN PATENT DOCUMENTS

| | | | |
|---|---|---|---|
| 0110732 | of 1928 | Austria | 132/279 |
| 1099834 | 9/1955 | France | 132/273 |

*Primary Examiner*—John J. Wilson
*Assistant Examiner*—Frank A. LaViola
*Attorney, Agent, or Firm*—Leon Gilden

[57] ABSTRACT

A hair band is arranged for securement of a hair grouping in surrounding relationship with a hair band, including a central rigid core of memory retentent material selectively receiving a sheath thereabout to accommodate hair groupings of various sizes within the band structure. A modification of the invention includes the sheath formed with a tubular chamber filled with a temperature sensitive liquid crystal to effect visual color change in response to ambient temperature. A further hair band organization utilizes a clasp member, wherein the clasp member includes a flexible arcuate top plate spaced from a bottom latch plate, with the latch plate including a medial friction plate equivalent to the hair band formed with bifurcated end and a central body mounting a resilient sleeve thereabout to provide frictional engagement between the medial friction plate and the bottom latch plate when in an assembled configuration.

1 Claim, 6 Drawing Sheets

HAIR BAND HAVING TEMPERATURE SENSITIVE LIQUID CRYSTAL

BACKGROUND OF THE INVENTION

1. Field of the Invention

The field of invention relates to hair band structure, and more particularly pertains to a new and improved hair band wherein the same is arranged for securement about a grouping of hair of an individual.

2. Description of the Prior Art

Various hair band structure is utilized in the prior art to secure and support groupings of hair therewithin. Groupings of hair due to fashion and for individual users, the organization sets forth a structure wherein a sheath member selectively positioned and secured about the hair band to alter effective diameter of the hair band structure to accommodate various widths of hair groupings. Prior art structure may be found for example in U.S. Pat. No. 3,842,849 to Goodman wherein a pony tail holder sets forth a clip structure for surroundingly securing a hair band utilizing an external clip and an internal resilient band member.

U.S. Pat. No. 3,301,266 to Hoffman sets forth a hair holder utilizing circle members mounted to opposed ends of an elastomeric loop.

U.S. Pat. No. 3,751,769 to Reiner sets forth a fastening device wherein a lip structure further utilizes a plurality of spheres mounted at each end of the loop structure utilizing a medial clip to permit varying of effective length of the structure.

U.S. Pat. No. 3,626,955 to Greenwood sets forth a further example of hair band structure utilizing a plurality of rings and spheres mounted to each end of the ring for selective securement within an opposing ring structure for securement of a hair portion therewithin.

As such, it may be appreciated that there continues to be a need for a new and improved hair band as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of hair bands now present in the prior art, the present invention provides a hair band wherein the same is arranged for securing various widths of groupings of hair therewithin. As such, the general purpose of the present invention, which will be described subsequently in greater detail, is to provide a new and improved hair band which has all the advantages of the prior art hair bands and none of the disadvantages.

To attain this, the present invention provides a hair band arranged for securement of a hair grouping in surrounding relationship with a hair band, including a central rigid core of memory retentent material selectively receiving a sheath thereabout to accommodate hair groupings of various sizes within the band structure. A modification of the invention includes the sheath formed with a tubular chamber filled with a temperature sensitive liquid crystal to effect visual color change in response to ambient temperature. A further hair band organization utilizes a clasp member, wherein the clasp member includes a flexible arcuate top plate spaced from a bottom latch plate, with the latch plate including a medial friction plate equivalent to the hair band formed with bifurcated end and a central body mounting a resilient sleeve thereabout to provide frictional engagement between the medial friction plate and the bottom latch plate when in an assembled configuration.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair band which has all the advantages of the prior art hair bands and none of the disadvantages.

It is another object of the present invention to provide a new and improved hair band which may be easily and efficiently manufactured and marketed.

It is a further object of the present invention to provide a new and improved hair band which is of a durable and reliable construction.

An even further object of the present invention is to provide a new and improved hair band which is susceptible of a low cost of manufacture with regard to both materials and labor, and which accordingly is then susceptible of low prices of sale to the consuming public, thereby making such hair bands economically available to the buying public.

Still yet another object of the present invention is to provide a new and improved hair band which provides in the apparatuses and methods of the prior art some of the advantages thereof, while simultaneously overcoming some of the disadvantages normally associated therewith.

Still another object of the present invention is to provide a new and improved hair band wherein the same utilizes a selective securable sheath mounted to a central core for altering an effective diameter of the central core, and may further utilize a tubular cavity securing a liquid crystal component to effect notice of temperature change variation for amusement and enjoyment of an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
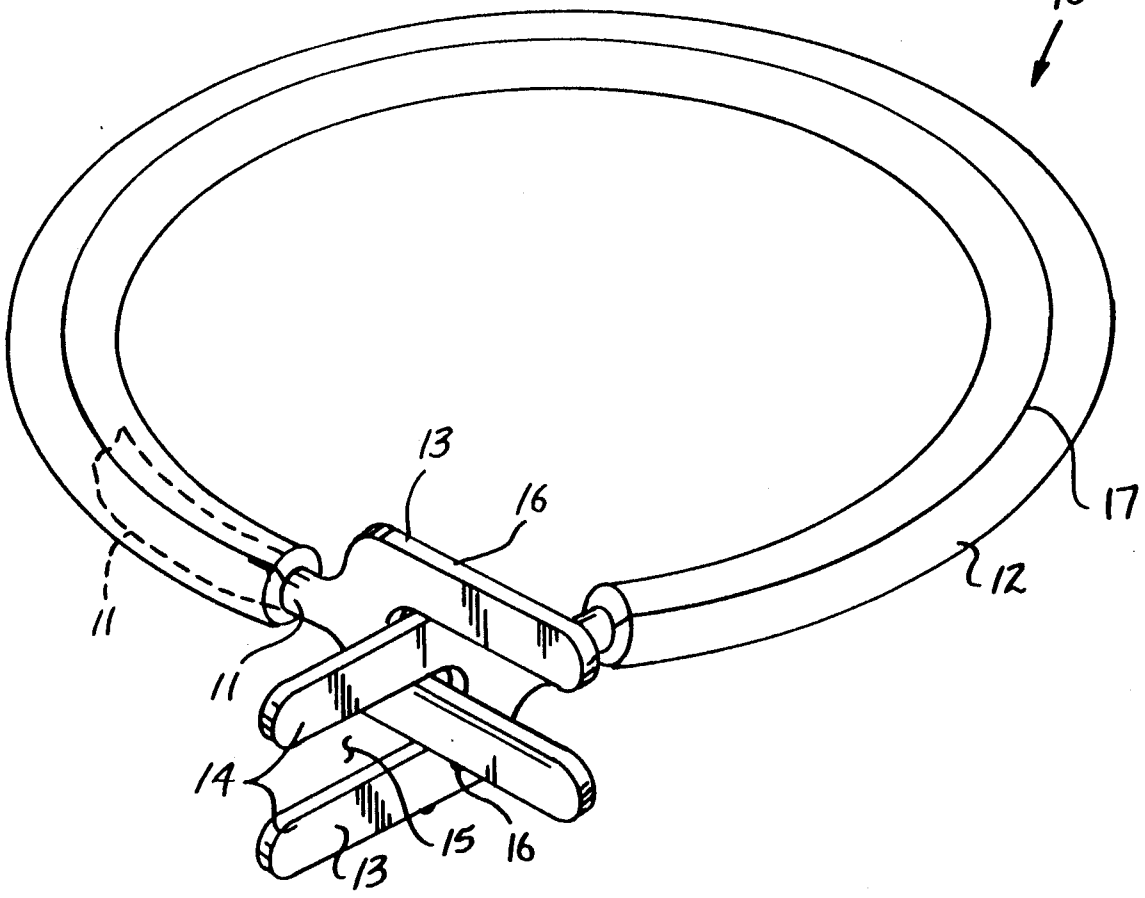
FIG. 1 is an isometric illustration of the instant invention.
Figure 2:
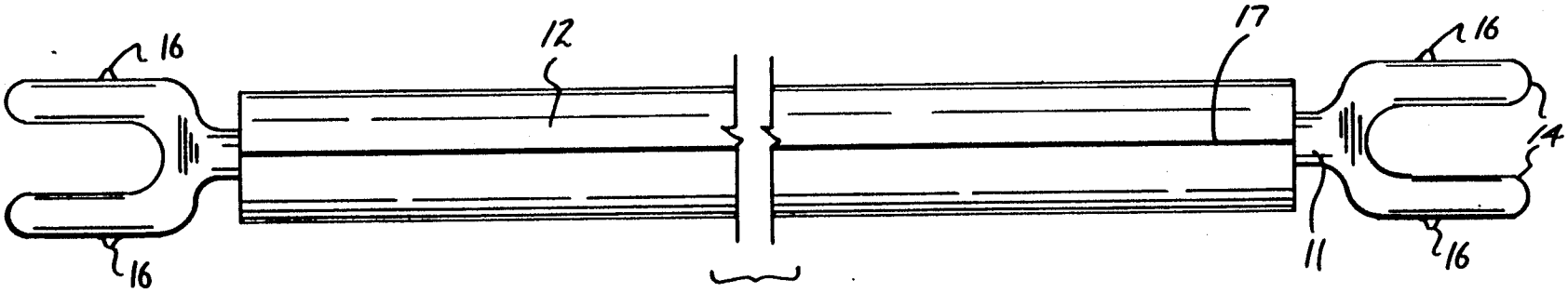
FIG. 2 is an orthographic side view of the instant invention.
Figure 3:
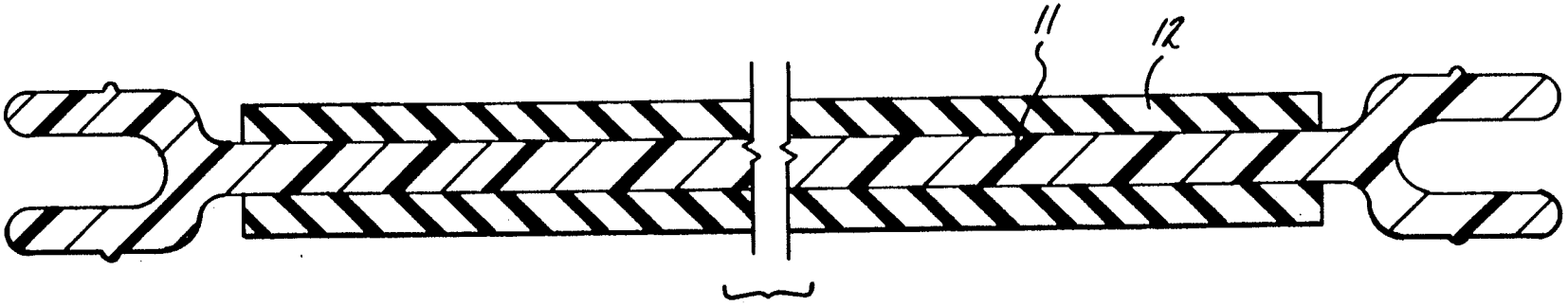
FIG. 3 is an orthographic cross-sectional illustration of the instant invention.

With reference now to the drawings, and in particular to FIGS. 1 to 9 thereof, a new and improved hair band embodying the principles and concepts of the present invention and generally designated by the reference numerals 10, 10*a*, and 10*b* will be described.

Figure 4:
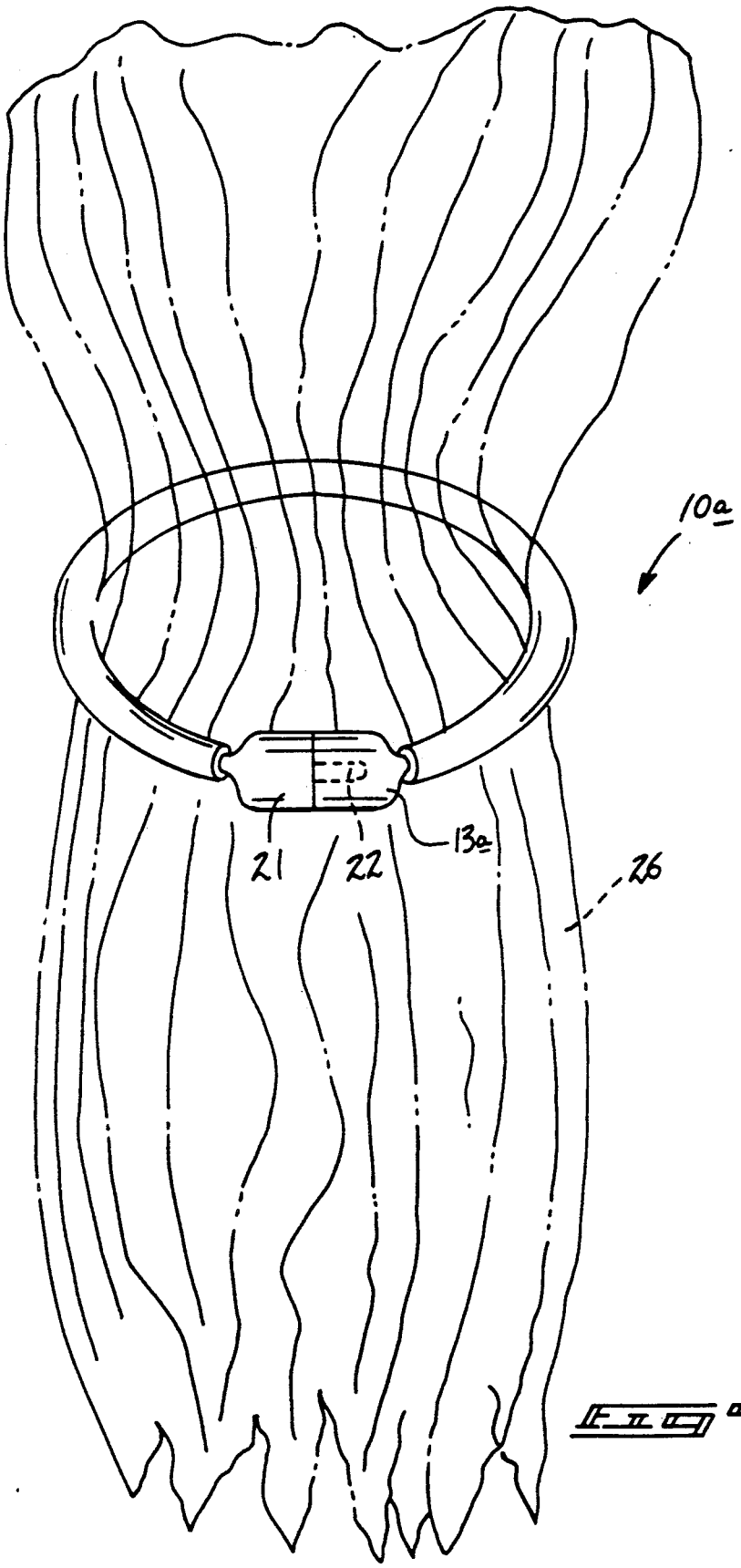
FIG. 4 is an isometric illustration of the apparatus utilizing a modified clip structure.

More specifically, the hair band 10 of the instant invention essentially comprises a resilient elongate shaft 11 formed of a memory retentent material defined by a first length, wherein a flexible tubular sheath 12 defined by a length substantially equal to the first length to substantially coextensively and selectively surroundingly mount the shaft 11 includes an elongate slit 17 coextensive with the sheath 12 to receive the shaft 11. In this manner, the effective diameter of the shaft is altered when the sheath is secured thereto for securing various widths of hair groupings 26, such as illustrated in FIG. 4. A "U" shaped fastener clip 13 is mounted to each end of the shaft 11, and includes parallel legs 14 defined each by a predetermined width, with a gap 15 therebetween defined by a width equal to the predetermined width, with projections 16 directed laterally and orthogonally relative to each side edge of each of the legs 14, whereupon the "U" shaped clips 13 are securable together by directing and projecting one of the legs 14 through a gap 15 of an opposing clip 13 adjacent a nearest portion of the gap 15 adjacent the shaft 11.

Figure 5:
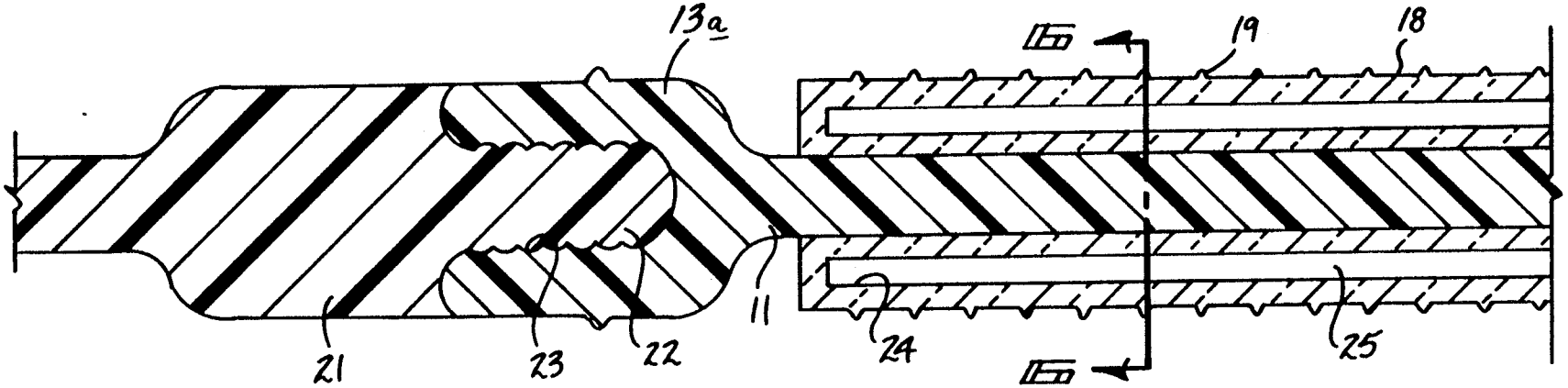
FIG. 5 is an orthographic cross-sectional illustration of a modified hair band structure utilizing a tublar cavity within the sheath to secure a liquid crystal therewithin.
Figure 6:
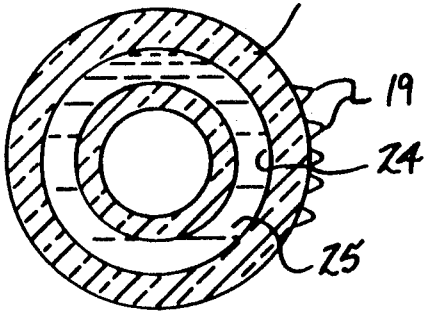
FIG. 6 is an orthographic view, taken along the lines 6—6 of FIG. 5 in the direction indicated by the arrows.

FIGS. 4–6 illustrate a modified aspect of the invention, wherein in lieu of the clips 13, a modified first clip 13*a* utilizes a central ribbed cavity 23 receiving a central external rear projection 22 within the cavity 23 as an alternative securement structure.

The organization 10*a* utilizes a modified sheath 18 formed of a transparent flexible material, with parallel rib segments 19 formed thereon, wherein each of the rib segments are defined by a plurality of spaced projections in an annular segment defined within a circle substantially orthogonal relative to an axis of the sheath 18. A tubular chamber 24 is completely contained within the sheath 18 and is substantially coextensive therewith, wherein the tubular chamber 24 is filled with a temperature sensitive liquid crystal 25. Such crystal is utilized to indicate temperature change and may be found for example in U.S. Pat. No. 4,835,899. The liquid crystal 25 will accordingly alter color upon ambient temperature to provide for an entertaining and enhanced structure for amusement and entertainment during its securement to the hair grouping 25.

Figure 7:
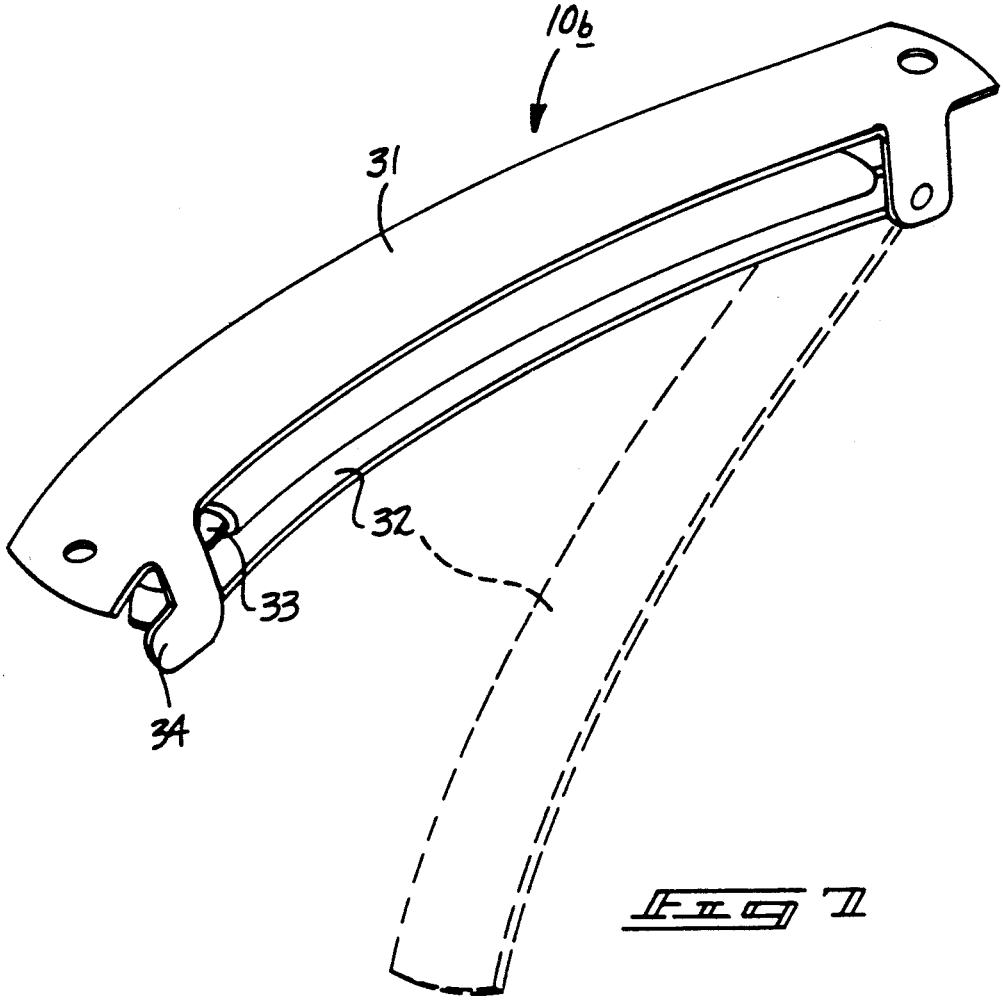
FIG. 7 is an isometric illustration of a further modified hair band defining a clasp member.
Figure 8:
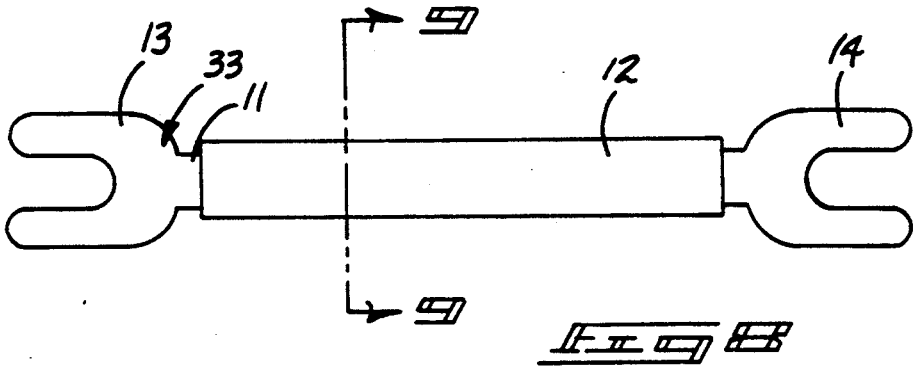
FIG. 8 is a top orthographic view of the medial friction plate equivalent to the hair band organization utilized by the instant invention.
Figure 9:
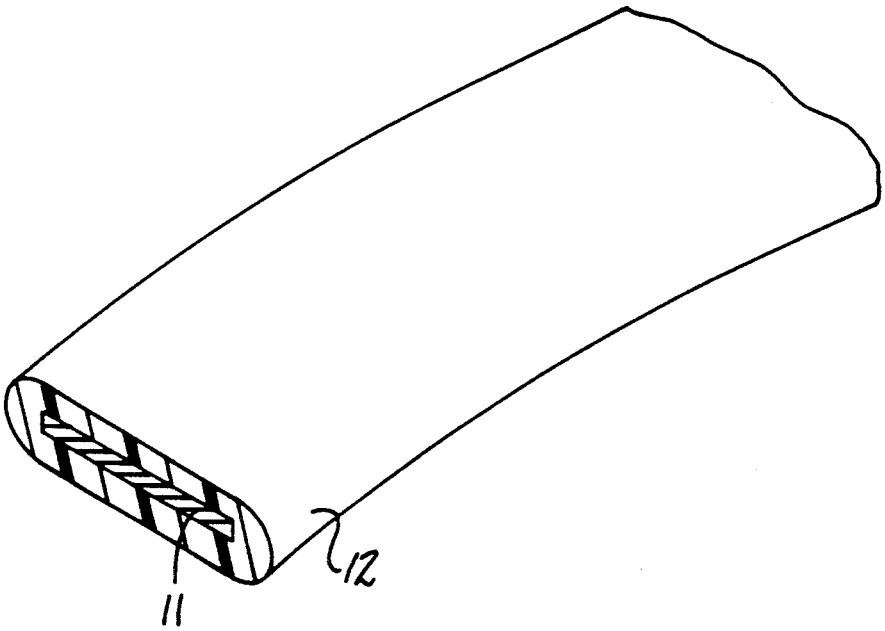
FIG. 9 is an orthographic view, taken along the lines 9—9 FIG. 8 in the direction indicated by the arrows.

FIGS. 7–9 illustrate a further hair band construction 10*b*, wherein a clasp member is defined by with a flexible arcuate top plate 31 formed of a flexible memory retentent material cooperative with a bottom latch plate 32 with a medial friction plate 33 equivalent to the hair band 10 positioned therebetween to secure portions of hair between the latch plate 32 and the medial friction plate 33. A clasp or latch mechanism 34 is utilized to secure the latch plate 32 to the downwardly projecting ears mounted to the flexible arcuate plate 31.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair band comprising, a resilient elongate shaft formed of a memory retentent material, and the shaft including a first end and a second end, the first end and second end include a first clip and a second clip, wherein the first clip and second clip are securable together in surrounding relationship relative to a hair grouping, and a flexible sheath, the flexible sheath selectively securable to the shaft, wherein the shaft is defined by a first length and the tubular sheath is defined by a further length substantially equal to the first length, and wherein the sheath includes an elongate slit coextensive with the sheath, wherein the slit permits insertion of the shaft within the sheath, and wherein each clip includes a "U" shaped member, the "U" shaped member each including parallel legs defined by a predetermined width, and each of the parallel legs defined a gap, wherein the gap is defined by a width equal to the predetermined width, and each of the legs include a projection orthogonally laterally of each side edge of each gap to permit securement of the first clip and second clip together, and wherein the sheath is transparent, and wherein the sheath includes a tubular chamber formed within the sheath, the tubular chamber is filled with a temperature sensitive liquid crystal to effect color changing of the liquid crystal in response to ambient temperature proximate the sheath.

* * * * *